US008695250B2

(12) United States Patent
O'Connor

(10) Patent No.: US 8,695,250 B2
(45) Date of Patent: Apr. 15, 2014

(54) SHARED SPACE DIVIDERS

(76) Inventor: Christi O'Connor, Santa Rosa, CA (US)

( * ) Notice: Subject to any disclaimer, the term of this patent is extended or adjusted under 35 U.S.C. 154(b) by 295 days.

(21) Appl. No.: 12/220,412

(22) Filed: Jul. 23, 2008

(65) Prior Publication Data

US 2009/0090075 A1 Apr. 9, 2009

Related U.S. Application Data

(60) Provisional application No. 60/961,807, filed on Jul. 23, 2007.

(51) Int. Cl.

| | |
|---|---|
| ***G09F 17/00*** | (2006.01) |
| ***G09F 19/00*** | (2006.01) |
| ***G09F 11/18*** | (2006.01) |
| ***G09F 15/00*** | (2006.01) |
| ***G09F 15/02*** | (2006.01) |

(52) U.S. Cl.

USPC ..... 40/603; 40/410; 40/514; 40/606.12; 40/124; 160/25; 160/119; 160/123; 160/130; 160/23.1; 160/27; 160/28; 160/122; 160/903; 160/10; 160/24; 160/241

(58) Field of Classification Search

USPC ..... 40/603, 410, 514, 606.12, 124; 160/25, 160/119, 123, 130, 23.1, 27, 28, 122, 903, 160/10, 24, 241

See application file for complete search history.

(56) References Cited

U.S. PATENT DOCUMENTS

| | | | | | |
|---|---|---|---|---|---|
| 363,345 | A | * | 5/1887 | Price et al. | 116/173 |
| 376,436 | A | * | 1/1888 | Harrison | 160/24 |
| 1,163,310 | A | * | 12/1915 | Beckley | 40/516 |
| 3,487,874 | A | * | 1/1970 | Solo | 160/24 |
| 3,698,104 | A | | 10/1972 | Sutton | 35/60 |
| 3,927,481 | A | | 12/1975 | Safranek | 35/60 |
| 3,986,461 | A | | 10/1976 | Steele | 108/60 |
| 4,124,196 | A | * | 11/1978 | Hipskind | 256/1 |
| 4,844,420 | A | | 7/1989 | Oster | 256/1 |
| 5,044,135 | A | | 9/1991 | Kroon et al. | 52/239 |
| D343,690 | S | | 1/1994 | Carey | D25/51 |
| 5,291,700 | A | | 3/1994 | Chew | 52/36.1 |
| 5,450,694 | A | | 9/1995 | Goranson et al. | 52/71 |
| 5,711,568 | A | * | 1/1998 | Diem et al. | 296/37.16 |
| 5,813,736 | A | * | 9/1998 | Ballew | 312/249.9 |
| 5,845,889 | A | | 12/1998 | Suzuki | 248/451 |
| 5,957,698 | A | | 9/1999 | Dean et al. | 434/350 |
| 5,967,161 | A | | 10/1999 | Neal | 135/19.5 |
| 5,987,794 | A | | 11/1999 | Lavi et al. | 40/611 |
| 6,009,930 | A | | 1/2000 | Jantschek | 160/135 |
| 6,056,038 | A | | 5/2000 | Foster et al. | 160/351 |

(Continued)

*Primary Examiner* — Syed A Islam

(74) *Attorney, Agent, or Firm* — Haverstock & Owens LLP

(57) ABSTRACT

A shared space divider provides privacy on surfaces. The shared space divider comprises a hub that is placed on a portion of a surface, and at least one partitioning structure coupled to a portion of the hub. The at least one partitioning structure comprises a separator configured to partition the surface into two or more sections. The separator has a ribbon structure, an accordion structure, or a fan structure. The at least one partitioning structure is configured to extend from and retract into or, alternatively, fold out from and fold into the hub. In some embodiments, the shared space divider comprises at least one container for holding items commonly found on the surface. In other embodiments, the shared space divider comprises a clip for attaching to documents. Yet, in other embodiments, images such as advertisements are displayed on at least one of the separator and the hub.

44 Claims, 11 Drawing Sheets

(56) References Cited

U.S. PATENT DOCUMENTS

| | | | | |
|---|---|---|---|---|
| 6,089,302 | A * | 7/2000 | Britt | 160/98 |
| 6,393,782 | B1 | 5/2002 | Berridge et al. | 52/239 |
| 6,644,736 | B2 | 11/2003 | Nguyen et al. | 297/184.17 |
| 6,695,103 | B2 | 2/2004 | Kauhaniemi et al. | 188/291 |
| 6,926,060 | B2 | 8/2005 | Mark | 160/135 |
| 7,150,127 | B2 | 12/2006 | Underwood et al. | 52/36.1 |
| 7,217,061 | B2 * | 5/2007 | Stratton | 404/6 |
| 2001/0038522 | A1 * | 11/2001 | Zheng | 361/680 |
| 2005/0077014 | A1 * | 4/2005 | Mark | 160/135 |
| 2007/0228349 | A1 * | 10/2007 | Smith | 256/12.5 |

* cited by examiner

SHARED SPACE DIVIDERS

RELATED APPLICATIONS

This application claims priority of U.S. provisional application, Ser. No. 60/961,807, filed Jul. 23, 2007, and entitled "Shared Work Space Dividers," by the same inventor. This application incorporates U.S. provisional application, Ser. No. 60/961,807, filed Jul. 23, 2007, and entitled "Shared Work Space Dividers" in its entirety by reference.

FIELD OF THE INVENTION

The invention relates to dividers. In particular, the invention relates to dividers for partitioning shared space.

BACKGROUND OF THE INVENTION

In public places such as restaurants, bars, coffee shops, hospitals, colleges, and libraries, and in private places such as homes, people are often required to share a surface, such as a counter top, a desk top, a table top, a bar or a bathroom counter top. Further, people prefer a greater degree of privacy in these public places. Accordingly, there is a need for an apparatus that provides limited privacy on surfaces in public and private places.

SUMMARY OF THE INVENTION

Embodiments of the present invention are directed to a shared space divider for providing privacy on a surface. The shared space divider includes a hub for attaching to or placing on the surface. The shared space divider further includes one or more partitioning structures that are configured to extend from and retract into or, alternatively, fold out from and fold into the hub. Each partitioning structure comprises an arm or extension, and a separator. The separator is formed from any suitable material including, but not limited to, plastic, mesh, cloth and paper. The separator is able to have a variety of designs. For example, the separator has a flat structure, ribbon structure, accordion structure, or fan structure, to name a few. In some embodiments, the shared space divider is referred to as ShareTops.

The shared space divider is typically a small, durable and attractive mechanism that sits on any surface such as a table top, a bathroom counter or an office desk. The shared space divider provides a separation between, for example, a user and any stranger who wishes to sit down and share the same table without having to start a conversation. On bar counters, two tops, four tops and all tops, the shared space divider acts as a substantial yet subtle partition between users that allows them to feel comfortable while sharing the same surface. The shared space divider splits any table into one or more sections.

The shared space divider is also a functional divider for daycare centers that wish to separate children and families at home who wish to divide those sitting at a table. The shared space divider allows people at one table to share the top with a feeling of separation from others using the same surface.

In some embodiments, the arm or extension of the shared space divider pulls out into an unobtrusive separator that can stretch partially across a table or to the end of the table depending on need. An end of the arm hooks onto the table. Alternatively, the end of the arm sticks to the table via a suction cup. Alternatively, the weight of the arm allows the arm to stay in place. Alternatively, the arm stays by a locking mechanism in a base of the shared space divider.

In some embodiments, a phrase such as "Thank You for Sharing" appears on a portion of the shared space divider, giving the stranger an implied permission to share the same space comfortably with the user. In an electronic version of the shared space divider, the phrase "Thank You for Sharing" appears on a ticker display located on the shared space divider, although other phrases, images, animation and advertisements are able to be displayed. The phrase is able to be static or is able to move across the ticker display. The shared space divider displaying the phrase typically requires even less obtrusiveness because the phrase automatically draws more attention to the intent to separate and divide the shared space.

In other embodiments, the shared space divider is also configured to display advertisements. As such, the shared space divider is a great marketing tool for places like restaurants.

The shared space divider easy to use and allows the user to return the table to its original non-divided state after the user is finished. In some embodiments, the shared space divider is also durable enough to be cleaned in a dishwasher for a thorough high heat cleaning. In other embodiments, the shared space divider is made from antibacterial material to prevent bacteria or germs from forming.

DETAILED DESCRIPTION OF THE PRESENT INVENTION

Figure 1A:
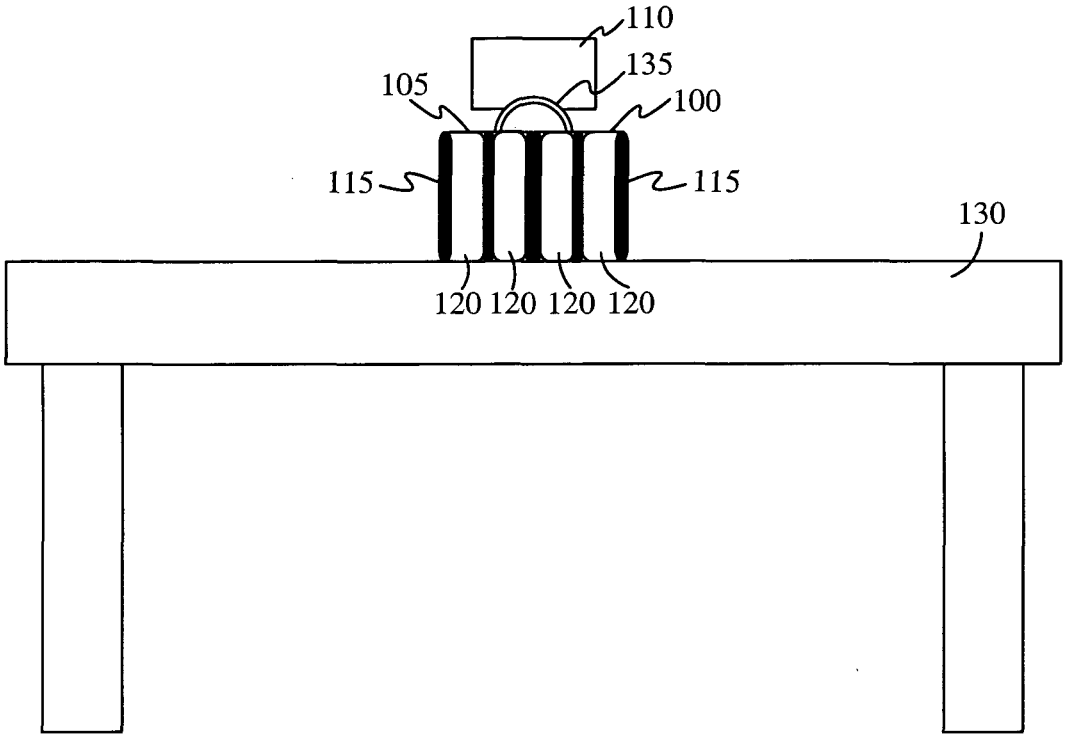
FIGS. 1 A-D illustrate a first exemplary shared work space divider in accordance with the present invention.

In the following description, numerous details are set forth for purposes of explanation. However, one of ordinary skill in the art will realize that the invention may be practiced without the use of these specific details or with equivalent alternatives.

Reference will now be made in detail to implementations of the present invention as illustrated in the accompanying drawings. The same reference indicators will be used throughout the drawings and the following detailed description to refer to the same or like parts.

Embodiments of the present invention are directed to a shared space divider for providing privacy on a surface, such as a work surface or a dining surface. In some embodiments, the shared space divider is referred to as ShareTops. The shared space divider typically includes a hub and at least one partitioning structure. The hub is typically placed on the surface. The at least one partitioning structure is typically configured to extend from and retract into or, alternatively, fold out from and fold into the hub. The shared space divider allows those at a table or counter to share space with a feeling of separation by partitioning the space.

The shared space divider need not be used on a surface but can also be used in other places where space needs to be divided. For example, the shared space divider is able to be used in a box to divide space within.

FIGS. 1A-D illustrate a first exemplary shared space divider 100 in accordance with the present invention. The shared space divider 100 comprises one or more partitioning structures. Although the shared space divider 100 is shown to have eight partitioning structures, any number of partitioning structures is possible. In some embodiments, the shared space divider 100 comprises a clip 135 mounted on a top of the shared space divider 100. The clip 135 is able to attach to a document 110, such as a menu, an ad, a flyer and the like. In other embodiments, the shared space divider 100 is stackable.

A hub 105 of the shared space divider 100 is typically cylindrically shaped, although other shapes are possible. One or more slits are vertically positioned along a side surface 120 of the hub 105. Each partitioning structure comprises a handle 115 that substantially covers a vertical length of the slit. Alternatively, the handle 115 covers a portion of the vertical length of the slit. The partitioning structure also comprises a separator 125. Typically, the handle 115 is coupled to a separator 125. The separator 125 is made from any suitable material including, but not limited to, plastic, mesh, cloth, and paper. The separator 125 is typically housed within the hub 125. The separator 125 in some embodiments is rolled around a spool located inside the hub 125. As such, the separator 125 has a ribbon structure. The handle 115 allows a user to unroll and pull the separator 125 out from the slit of the hub 105. The partitioning structure also comprises an attachment means (not illustrated). The attachment means is a temporary attachment pairing. In some embodiments, a hook is coupled to a bottom of a portion of the partitioning structure, such as the handle 115, for attaching and securing to a table 130. Alternatively, a suction cup is coupled to the bottom of the handle 115 for attaching and securing to the table 130. Alternatively, the handle 115 is weighted such that the separator 125 stays in place when the separator 125 is pulled out from the hub 105. Other attachment means, such as hook and loop fasteners, snaps, buttons, zippers, cooperative screw thread, friction coupling, are possible.

Figure 1B:
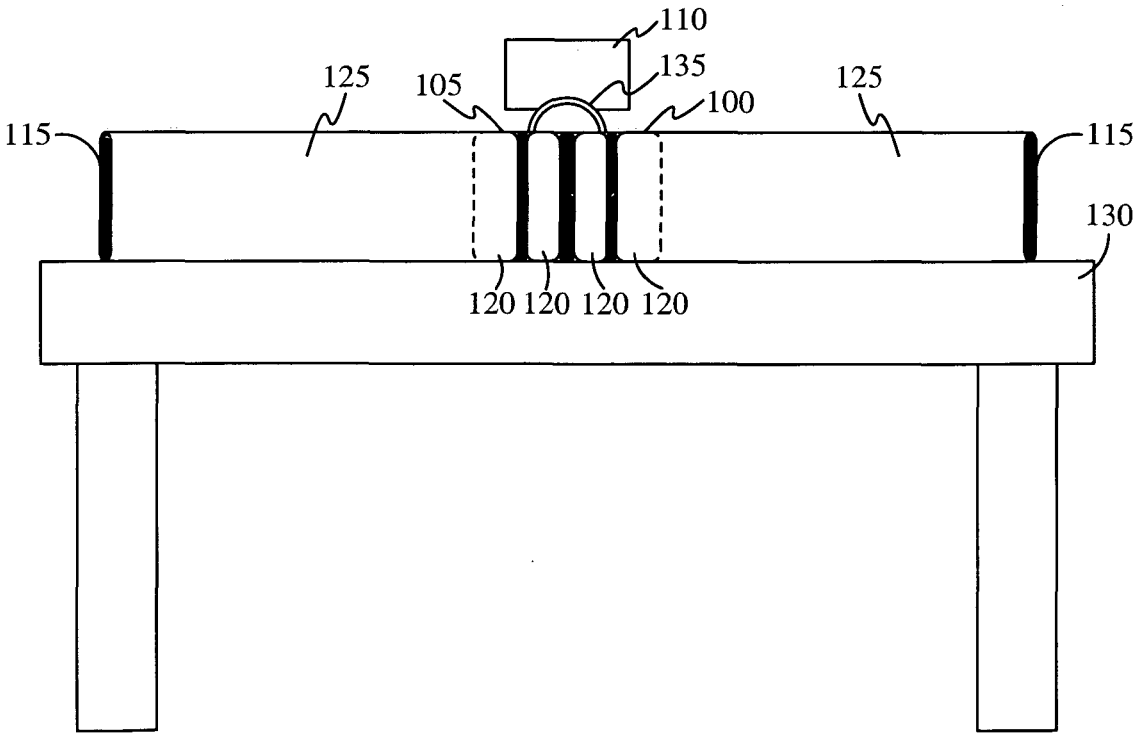

While FIG. 1A illustrates a side view of the shared space divider 100 in a closed configuration on the table 130, FIG. 1B illustrates a side view of the shared space divider 100 in an open configuration on the table 130 with two separators 125 on opposite sides pulled out from the shared space divider 100. Each separator 125 can be pulled or stretched out to any desired length by using the handle 115. For example, a separator 125 can be pulled or stretched out partially across the table 130 or to an end of the table 130. When not in use, the separator 125 can be retracted into the hub 105.

Figure 1C:
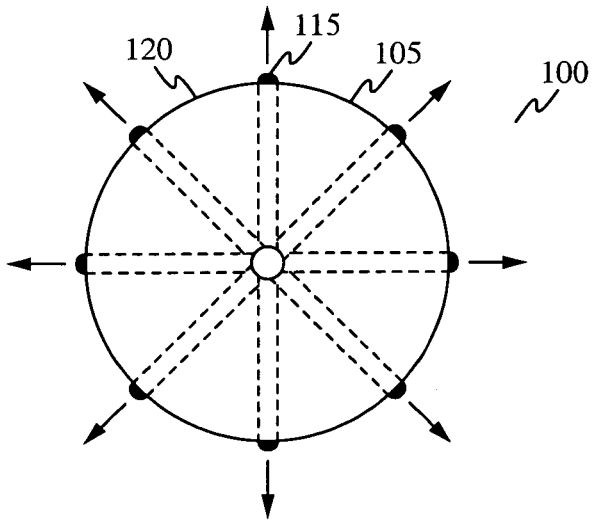
Figure 1D:
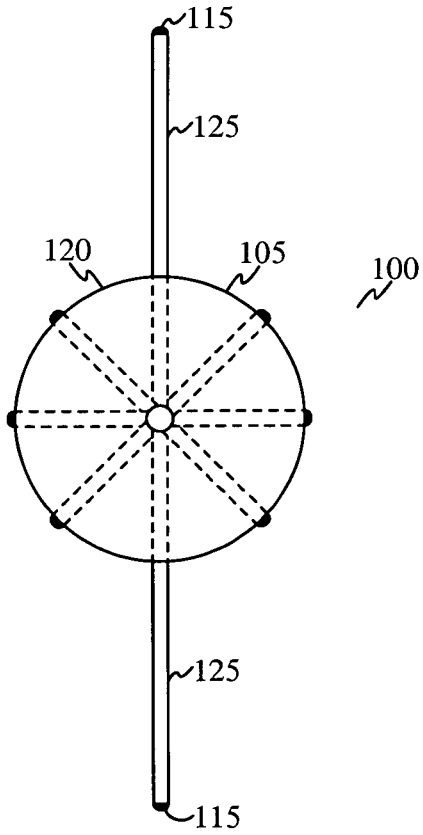

While FIG. 1C illustrates a top view of the shared space divider 100 in the closed configuration, FIG. 1D illustrates a top view of the shared space divider 100 in the open configuration with two separators 125 on opposite sides pulled out from the shared space divider 100. The shared space divider 100 has eight handle bars 115, each coupled to a corresponding separator 125 discussed above. The handle bars 115 are configured to be pulled in directions indicated by arrows.

Figure 2A:
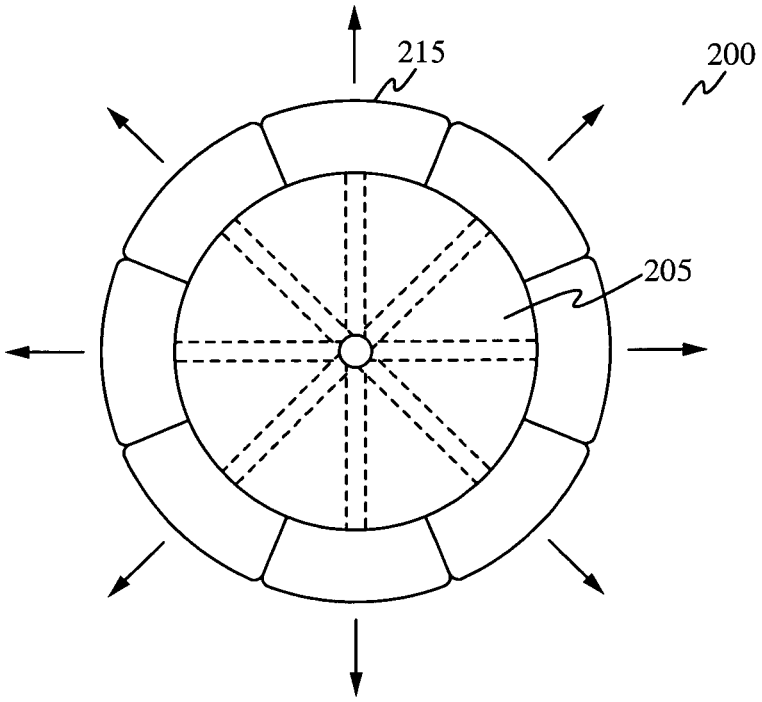
FIGS. 2A-B illustrate a second exemplary shared work space divider in accordance with the present invention.
Figure 2B:
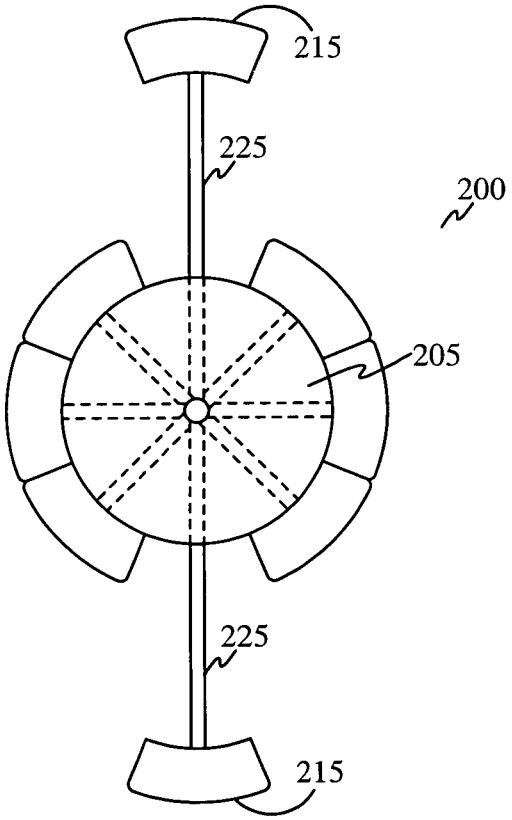

FIGS. 2A-B illustrate a second exemplary shared space divider 200 in accordance with the present invention. Specifically, FIG. 2A illustrates a top view of the shared space divider 200 in a closed configuration, and FIG. 2B illustrates a top view of the shared space divider 200 in an open configuration with two separators 225 on opposite sides pulled out from the shared space divider 200. Although the shared space divider 200 is shown to have eight partitioning structures, any number of partitioning structures is possible. In some embodiments, the shared space divider 200 comprises a clip (not illustrated) mounted on a top of the shared space divider 200. In other embodiments, the shared space divider 200 is stackable.

A hub 205 of the shared space divider 200 is typically cylindrically shaped, although other shapes are possible. One or more slits are vertically positioned along a side surface of the hub 205. Each partitioning structure comprises a block 215 coupled to a separator 225. An inside surface of the block 215 is similarly curved as an outside surface of the hub 205 such that in a closed configuration, the block 215 is positioned flush against the hub 205. The block 215 in some embodiments is gripped to allow the user to pull the separator 225 out from the slit of the hub 205. The separator 225 is similarly configured as the separator 125 of the shared space divider 100. The partitioning structure also comprises an attachment means that is similarly configured as the attachment means of the shared space divider 100.

Figure 3A:
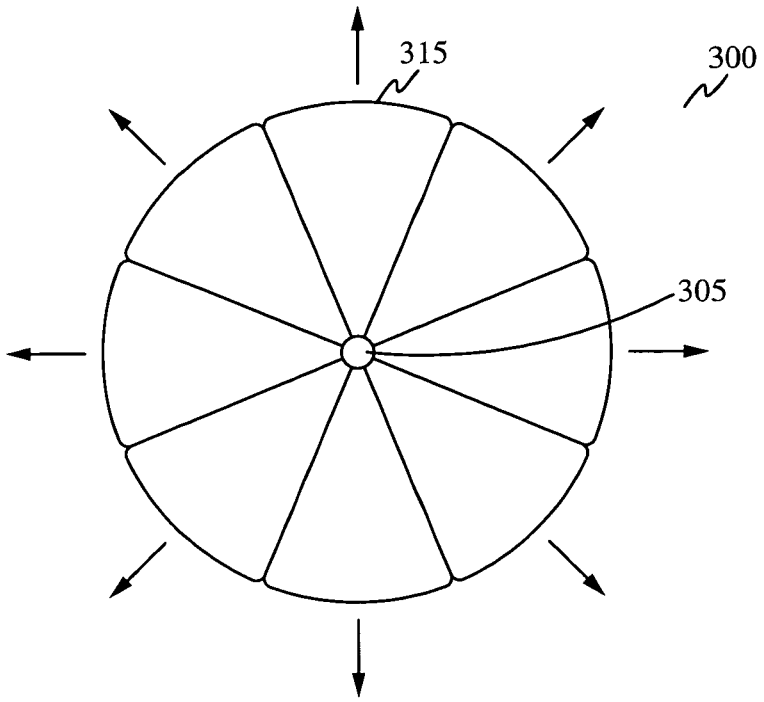
FIGS. 3A-B illustrate a third exemplary shared work space divider in accordance with the present invention.
Figure 3B:
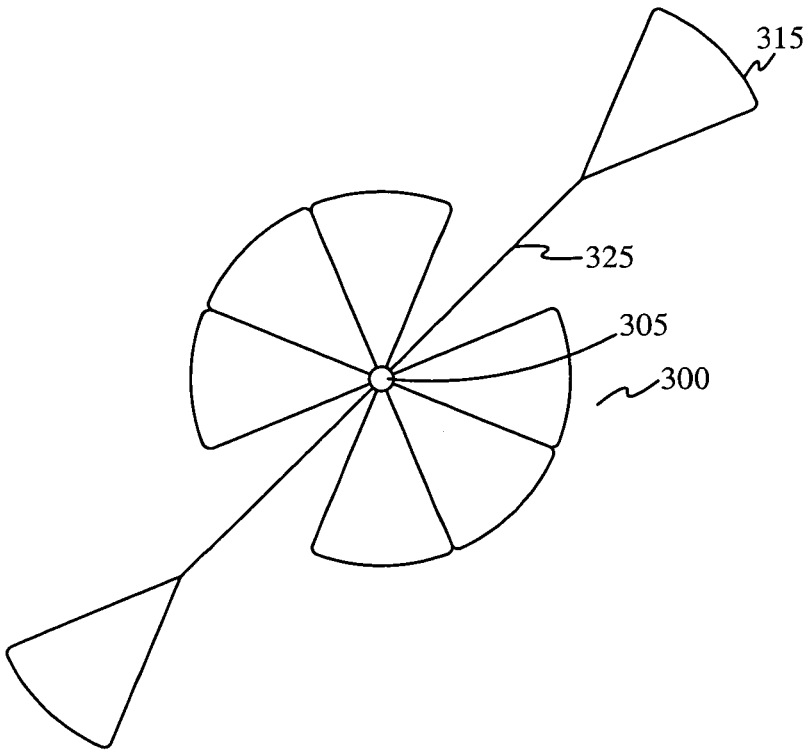

FIGS. 3A-B illustrate a third exemplary shared space divider 300 in accordance with the present invention. Specifically, FIG. 3A illustrates a top view of the shared space divider 300 in a closed configuration, and FIG. 3B illustrates a top view of the shared space divider 300 in an open configuration with two separators 325 on opposite sides pulled out from the shared space divider 300. Although the shared space divider 300 is shown to have eight partitioning structures, any number of partitioning structures is possible. In some embodiments, the shared space divider 300 comprises a clip (not illustrated) mounted on a top of the shared space divider 300. In other embodiments, the shared space divider 300 is stackable.

A hub 305 of the shared space divider 300 is typically cylindrically shaped, although other shapes are possible. One or more slits are vertically positioned along a side surface of the hub 305. Each partitioning structure comprises a wedge 315 coupled to a separator 325. The wedge 315 in some embodiments is gripped to allow the user to pull the separator 325 out from the slit of the hub 305. The separator 325 is similarly configured as the separator 125 of the shared space divider 100. The partitioning structure also comprises an attachment means that is similarly configured as the attachment means of the shared space divider 100.

Figure 5A:
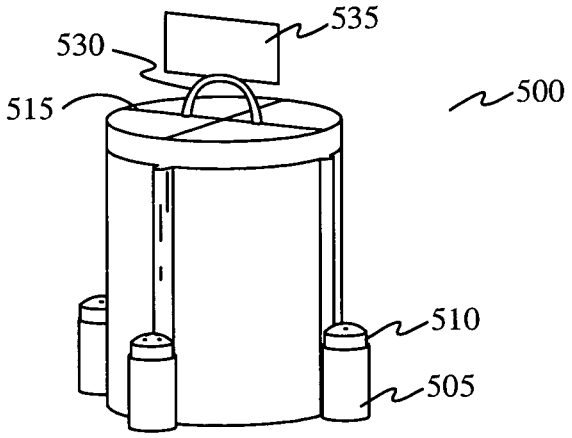
FIGS. 5A-B illustrate a fourth exemplary shared work space divider in accordance with the present invention.
Figure 5B:
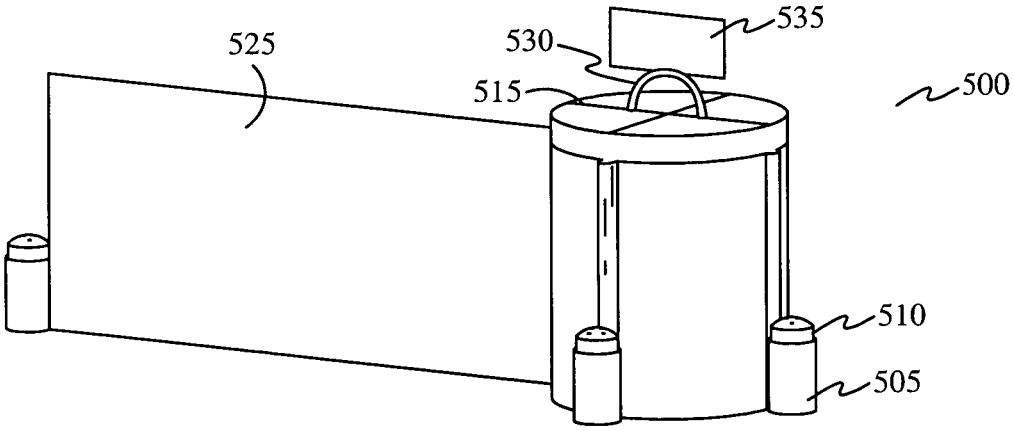

In some embodiments, a shared space divider comprises one or more containers or holders. The containers are able to hold salt and pepper shakers, bottles, pencils and pens, crayons, business cards, notepads, makeup, toothbrushes, and other items regularly used at and/or commonly found on a table, a bar, a counter, and the like. FIGS. 5A-B illustrate a fourth exemplary shared space divider 500 having containers in accordance with the present invention. Specifically, FIG. 5A illustrates an isometric view of the shared space divider 500 in a closed configuration, and FIG. 5B illustrates an isometric view of the shared space divider 500 in an open configuration with one separator 525 pulled out from the shared space divider 500. Although the shared space divider 500 is shown to have four partitioning structures, any number of partitioning structures is possible. In some embodiments, the shared space divider 500 comprises a clip 530 mounted on a top of the shared space divider 500. The clip 530 is able to attach to a document 535, such as a menu, an ad, a flyer and the like.

A hub 515 of the shared space divider 500 is similarly configured as the hub 105 of the shared space divider 100. Four slits are vertically positioned along a side surface of the hub 515. Each partitioning structure comprises a container 505 coupled to a separator 525. Not only does the container 505 allow placement of, for example, salt and pepper shakers 510, the container 505 allows the user to pull the separator 525 out from the slit of the hub 515. The separator 525 is similarly configured as the separator 125 of the shared space divider 100. The partitioning structure also comprises an attachment means that is similarly configured as the attachment means of the shared space divider 100.

Figure 6A:
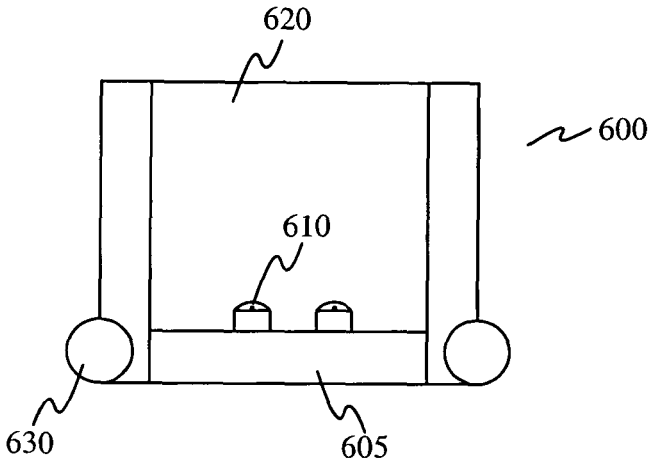
FIGS. 6A-B illustrate a fifth exemplary shared work space divider in accordance with the present invention.
Figure 6B:
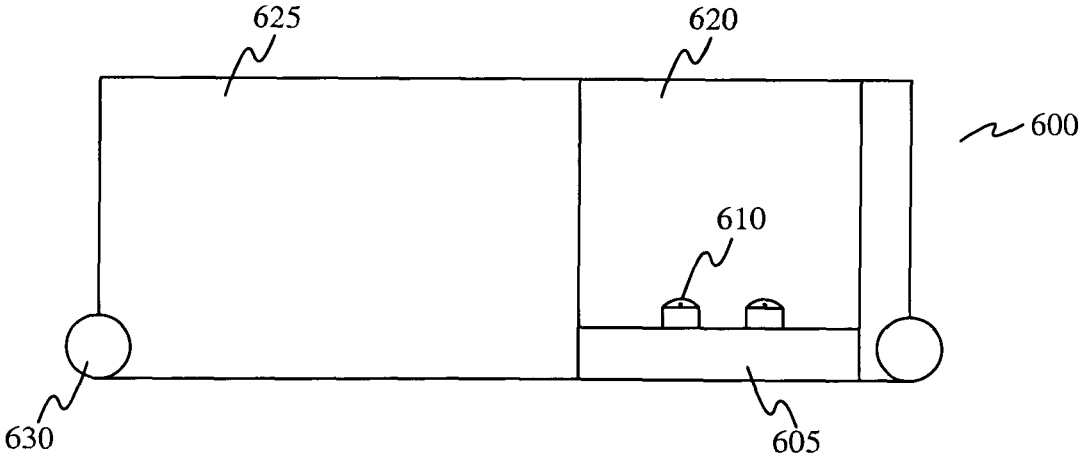

FIGS. 6A-B illustrate a fifth exemplary shared space divider 600 having holders in accordance with the present invention. Specifically, FIG. 6A illustrates an isometric view of the shared space divider 600 in a closed configuration, and FIG. 6B illustrates an isometric view of the shared space divider 600 in an open configuration with one separator 625 pulled out from the shared space divider 600. The shared space divider 600 is shown to have two partitioning structures. In some embodiments, the shared space divider 600 comprises a clip (not illustrated) mounted on a top of the shared space divider 600.

The shared space divider 600 comprises a rectangular hub 620. Each face of the rectangular hub 620 is coupled to a container 605. The container 605 allows placement of, for example, salt and pepper shakers 610. A slit is vertically positioned along each end of the rectangular hub 620. A partitioning structure in some embodiments comprises a knob 630 coupled to a separator 625. The knob 630 in some embodiments is gripped to allow the user to pull the separator 625 out from the slit of the hub 620. The separator 625 is similarly configured as the separator 125 of the shared space divider. The partitioning structure also comprises an attachment means that is similarly configured as the attachment means of the shared space divider 100.

Figure 7A:
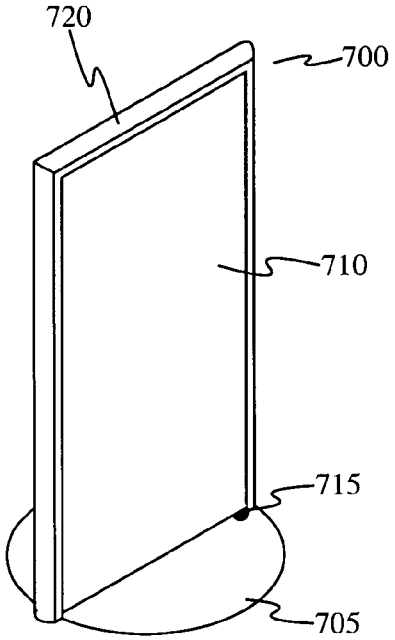
FIGS. 7A-C illustrate a sixth exemplary shared work space divider in accordance with the present invention.
Figure 7B:
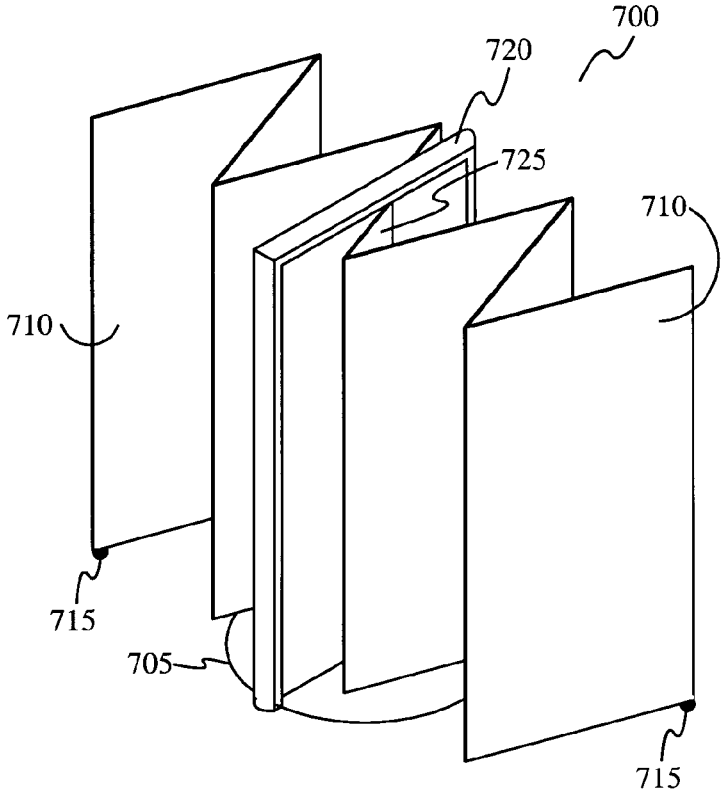
Figure 7C:
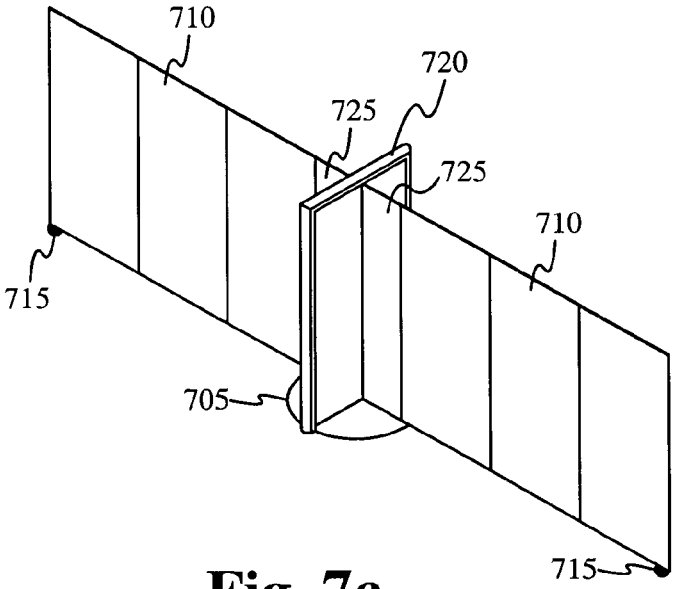

In other embodiments, a shared space divider is relatively narrow or flat such that the shared space divider is able to be stored in a confined or limited surface when the shared space divider is not in use. FIGS. 7A-C illustrate a sixth exemplary shared space divider 700 in accordance with the present invention. Specifically, FIG. 7A illustrates an isometric view of the shared space divider 700 in a closed configuration, FIG. 7B illustrates an isometric view of the shared space divider 700 in a partially open configuration, and FIG. 7C illustrates an isometric view of the shared space divider 700 in a fully open configuration with two separator 710 unfolded and stretched out from the shared space divider 700. The shared space divider 700 is shown to have two partitioning structures. In some embodiments, the shared space divider 700 comprises a clip (not illustrated) mounted on a top of the shared space divider 700.

The shared space divider 700 comprises a flat, rectangular hub 720 and a base 705. Each face of the rectangular hub 720 is coupled to a partitioning structure. The partitioning structure comprises an extension piece 725 coupled to a separator 710. The separator 710 typically has an accordion structure. The separator 710 is made from any suitable material including, but not limited to, plastic, mesh, cloth, and paper. A bottom corner of the separator 625 is attached to a pull tab 715. The pull tab 715 in some embodiments is gripped to allow the user to unfold and stretch out the separator 710. The partitioning structure also comprises an attachment means that is similarly configured as the attachment means of the shared space divider 100. Each separator 710 can be unfolded and stretched out to any desired length by using the pull tab 715. For example, the separator 710 can be pulled or stretched out partially across the table or to an end of the table. When not in use, the separator 710 can be folded back and the pull tab 715 able to be secured to a portion of the rectangular hub 720 and/or the base 705 to prevent the separator 710 from unfolding.

Figure 8A:
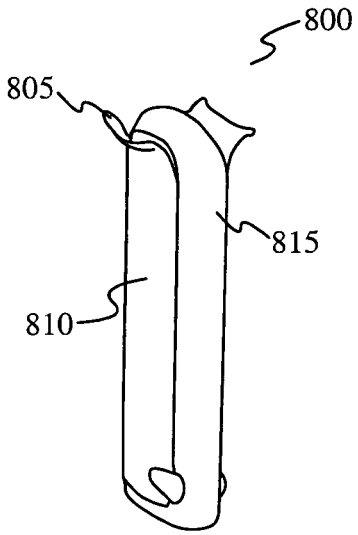
FIGS. 8A-B illustrate a seventh exemplary shared work space divider in accordance with the present invention.
Figure 8B:
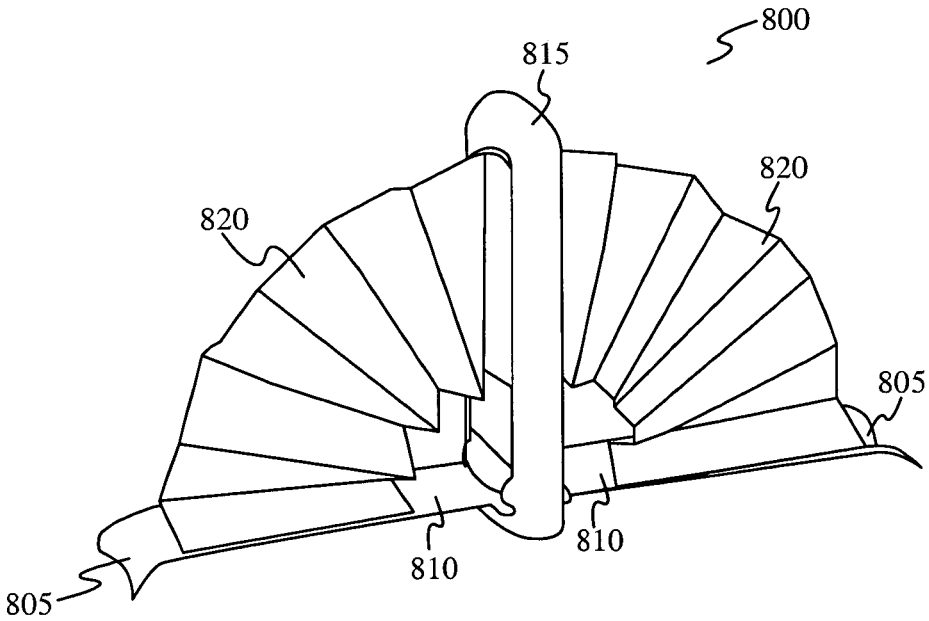

FIGS. 8A-C illustrate a seventh exemplary shared space divider 800 in accordance with the present invention. Specifically, FIG. 8A illustrates an isometric view of the shared space divider 800 in a closed configuration, and FIG. 8B illustrates an isometric view of the shared space divider 800 in an open configuration with two separators 820 unfolded and stretched out from the shared space divider 800. The shared space divider 800 is shown to have two partitioning structures. In some embodiments, the shared space divider 800 comprises a clip (not illustrated) mounted on a top of the shared space divider 800.

The shared space divider 800 comprises a narrow hub 815. Each face of the narrow hub 815 is coupled to a partitioning structure. The partitioning structure comprises a side platform 810, a tab 805 and a separator 820. The tab 805 is typically attached to a top end of the side platform 810. An interior surface of the side platform 810 is coupled to the separator 820. The separator 820 typically has a fan structure. The separator 820 is made from any suitable material including, but not limited to, plastic, mesh, cloth, and paper. The tab 805 in some embodiments is gripped to allow the user to pull out and unfold the separator 820. The partitioning structure also comprises an attachment means that is similarly configured as the attachment means of the shared space divider 100. Alternatively, a locking mechanism is engaged when the side platform 810 is perpendicular to the narrow hub 815. When not in use, the separator 820 can be folded back and the tab 805 is secured to a top portion of the narrow hub 815 to prevent the separator 820 from unfolding.

In some embodiments, a shared space divider is also configured to be a marketing tool. For example, logos, ads, pictures, and other images are able to be displayed on a surface of a hub, on separators, or both. The logos, ads, pictures, and other images are able to be removably coupled to the surface, the separators, or both. The logos, ads, pictures, and other images are able to be drawn on the surface, separators, or both, and are able to be erased. Alternatively, the logos, ads, pictures, other images are printed on the surface, separators, or both during manufacture. As such, the shared space divider is a great marketing tool for places like restaurants.

Figure 9A:
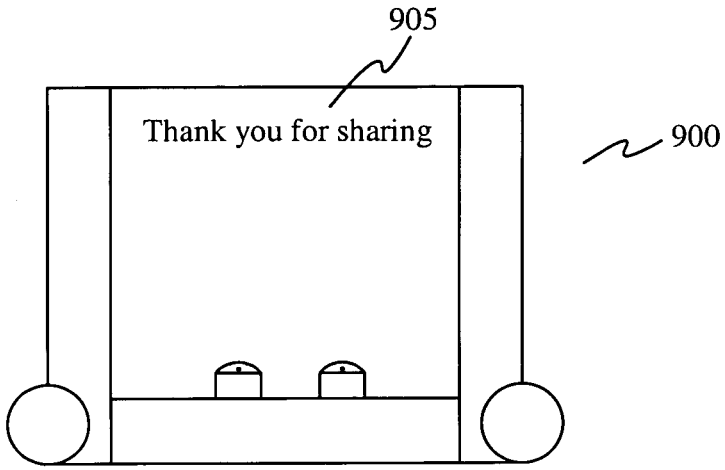
FIG. 9A illustrates a side view of an exemplary phrase displayed on a shared space divider in accordance with the present invention.

In some embodiments, a phrase or message appears on a portion of a shared space divider to give the user an implied permission to share the same space comfortably with someone already using the space. FIG. 9A illustrates a side view of an exemplary phrase 905 displayed on a shared space divider 900 in accordance with the present invention. As illustrated in FIG. 9A, the phrase 905 "Thank You for Sharing" appears on an upper portion of the shared space divider 900. The phrase 905 in some embodiments is a trademarked phrase or advertisement.

Figure 9B:
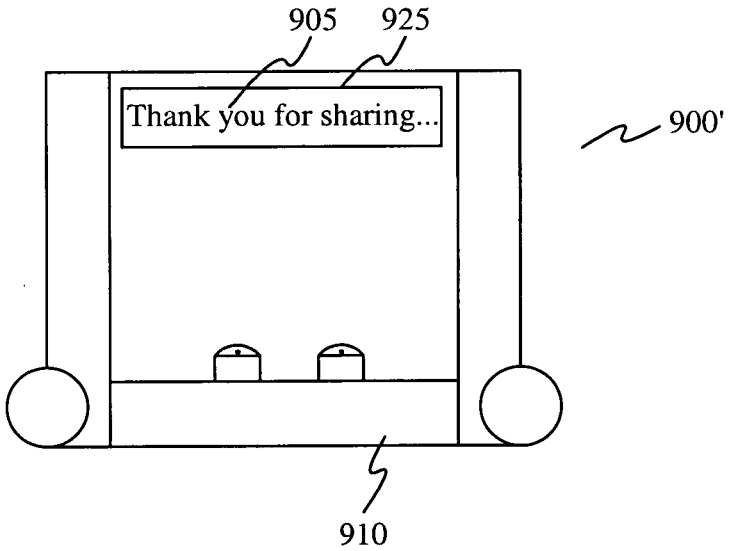
FIG. 9B illustrates a side view of an exemplary phrase displayed on an electronic shared space divider in accordance with the present invention.

Alternatively, the phrase is able to appear on a ticker display located on an electronic version of shared space divider. FIG. 9B illustrates a side view of the exemplary phrase 905 displayed on an electronic shared space divider 900'. As illustrated in FIG. 9B, the electronic shared space divider 900' comprises a ticker display 925. The ticker display 925 in some embodiments is an LED display. The ticker display 925 in some embodiments is an LCD display. The ticker display 925 is located at an upper portion of the electronic shared space divider 900'. Alternatively, the ticker display 925 is located on a container 910 that is coupled to the electronic shared space divider 900'. Other locations of the ticker display 910 on the electronic shared space divider 900' are possible. Other phrases are able to be displayed in the ticker display 910. For example, at a restaurant, the ticker display 925 displays "Your order is ready" to alert a seated customer. At a hospital, the ticker display 925 displays "The doctor would like to see you now" to alert a waiting patient in a lobby. Similarly, news headlines, animation, images, advertisements and the like are able to be displayed in the ticker display 925. The ticker display 925 varies in size, diameter and length. The phrase 905 is able to be static or is able to move across the ticker display 925.

Figure 9C:
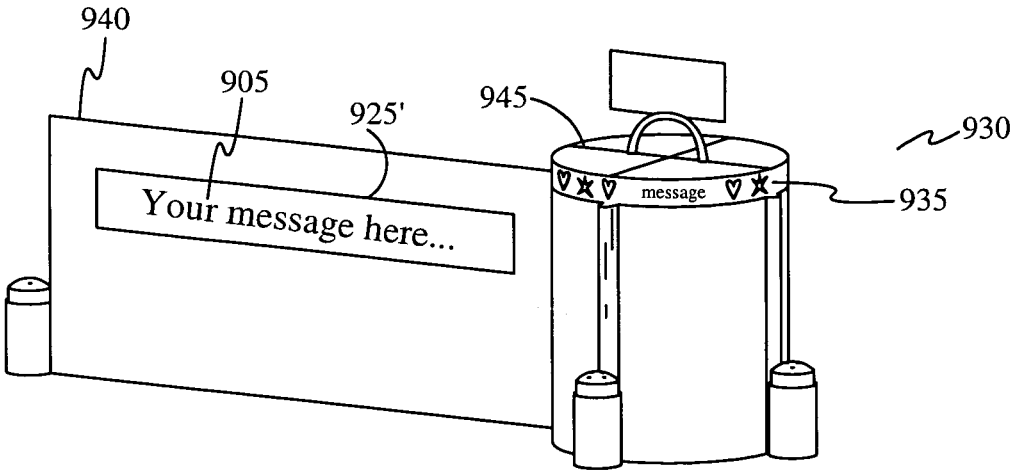
FIG. 9C illustrates a side view of an exemplary phrase displayed on another electronic shared space divider in accordance with the present invention.

In other embodiments, phrases, news headlines, animation, images and advertisements are able to be displayed across a separator when the separator is pulled out or extended from a hub. FIG. 9C illustrates a side view of an exemplary phrase displayed on another electronic shared space divider 930. A separator 940 is pulled out from a hub 945. The ticker display 925' in some embodiments is a narrow display located on a portion of the separator 940. The ticker display 925' in some embodiments is substantially the same dimensions as the separator 940. As illustrated in FIG. 9C, the ticker display 925' on the separator 940 displays the phrase 905 "Your message here. . . " The separator 940 is able to have two ticker displays 925'; for example, a ticker display 925' is on each face of the separator 940. In other embodiments, the ticker display can also be located around a circumference of the hub 945. For example, the ticker display is located at a top portion 935 of the hub 945. As illustrated in FIG. 9C, the ticker display located at the top portion 935 of the hub 945 displays hearts, stars, and a message.

Phrases, news headlines, animation, images, and advertisements to be displayed on the ticker display are programmable. In some embodiments, the ticker display is programmable from a remote device. The shared space divider is able to receive such information wirelessly or through a wired connection. Alternatively, the electronic shared space divider has a programmable interface. In other embodiments, the information being displayed is able to move across different ticker displays on the electronic shared space divider.

The shared space divider 900, 900', 930 typically requires even less obtrusiveness because the phrase 905 automatically draws more attention to the intent to separate and divide the shared space. In other embodiments, the electronic shared space divider 900' also includes speakers (not illustrated) to announce the message displayed in the ticker display 925. The electronic shared space divider 900' is also able to include a volume controller (not illustrated). These features are particularly helpful for people who are visually-impaired.

In some embodiments, the hub of the shared space divider is configured to be disassembled such that the separators can be removed and new separators with different images can be used. It should be recognized that the described embodiments are presented by way of example only and do not limit the invention.

Figure 4A:
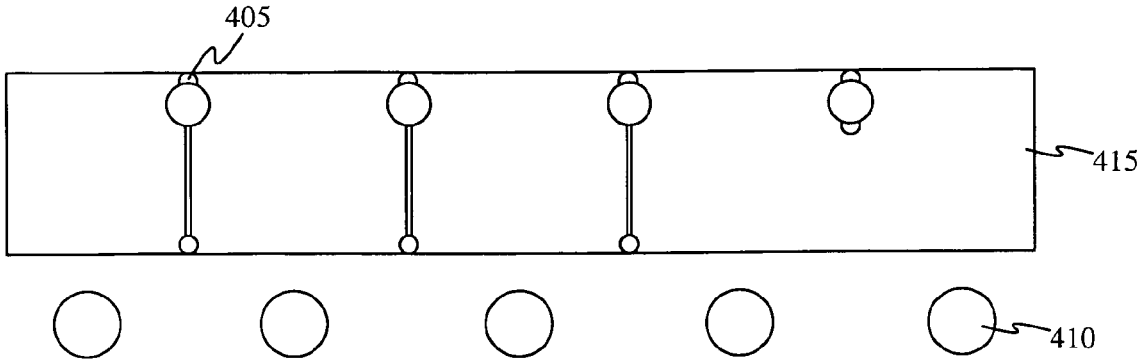
FIGS. 4A-C illustrate exemplary partitions using a shared work space divider in accordance with the present invention.
Figure 4B:
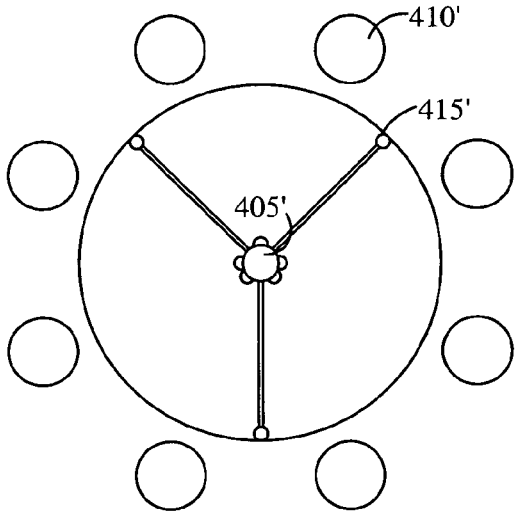
Figure 4C:
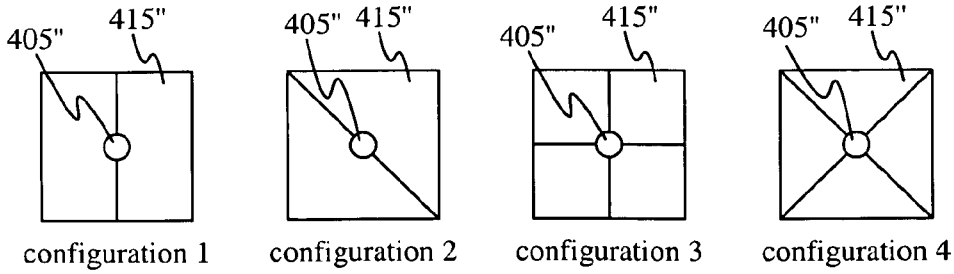

FIGS. 4A-C illustrate top views of exemplary partitions using shared space dividers in accordance with the present invention. In FIG. 4A, the shared space dividers are used on a bar or a counter top 415. At times, individuals sitting on seats 410 at the bar 415 do not know each other and want privacy. As such, the shared space dividers are placed on one edge of the bar 415, and the separators are pulled out and are attached to a second edge of the bar 415 via attachment means. An individual is able to extend a separator when the separator is needed and retract the separator when the separator is no longer needed.

In FIG. 4B, a shared space divider is used at a table 415', such as in a restaurant, a classroom, coffee shop, and library, and the like. For purposes of this illustration, assume that there are not enough tables for customers at the restaurant. By using the shared space divider, a first party of three, a second party of three, and a third party of two are able to sit at the same table 415' of eight. Preferably, the shared space divider is placed in a center of the table 415'. Three separators are pulled out such that three sections of the table 415' are formed. The three separators are attached to an outer edge of the table 415' via the attachment means. The first partition allows the first party of three (as indicated by a group of three seats 410') to enjoy their meal in privacy, the second partition allows a second party of three (as indicated by another group of three seats 410') to enjoy their meal in privacy, and the third partition allows the party of two (as indicated by a group of two seats 410') to enjoy their meal in privacy. When one party leaves the table 415', an extended separator used by that party can be retracted to provide more space to an adjoining section, allowing a remaining party to enjoy more space.

While FIG. 4B illustrates a round table 415', FIG. 4C illustrates a table 415" with parallel sides such as a square. Configuration 1 and configuration 2 illustrate two ways of using the shared space divider to form two partitions at the table 415". In configuration 1, the table 415" is partitioned into two rectangular halves. In configuration 2, the table 415" is partitioned into two triangular halves. Configuration 3 and configuration 4 illustrate two ways of using the shared space divider to form four partitions at the table 415". In configuration 3, the table 415" is partitioned into four square quadrants. In configuration 4, the table 415" is partitioned into four triangular quadrants. It should be recognized that the described embodiments are presented by way of example only and do not limit the invention.

In all embodiments, the shared space divider easy to use and advantageously allows the user to divide a table to share with others with a feeling of separation. The user is able to easily return the table to its original non-divided state after use. Not only is the shared space divider a marketing tool for places like restaurants, it is a functional divider for daycare centers who wish to separate children and families at home who wish to divide those sitting at a table. In some embodiments, the shared space divider is made from antibacterial material, such as hygienic plastic, to prevent bacteria or germs from forming. In other embodiments, the shared space divider is also durable enough to be cleaned in a dishwasher for a thorough high heat cleaning. The shared space divider is durable and withstand dishwashing, drying and wear and tear of daily use on any high traffic surface.

The shared space divider is able to vary in height dimension. In some embodiments, the shared space divider has a predetermined height as set during manufacture. For example, a shared space divider is manufactured to be six inches tall for use at a daycare center, or is manufactured to be more than a foot tall for use at a restaurant. However, separation height can be increased by stacking together two or more shared space dividers. In this configuration, a top separator is typically joined to a bottom separator via a temporary joining mechanism.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A device to partition a surface comprising:

a. a hub having a housing, wherein the hub is positioned on a portion of the surface; and b. at least two partitioning structures coupled to a portion of the hub and each having a flexible portion with a rigid handle that extends the length of an end of the flexible portion, wherein the flexible portion of each of the partitioning structures is enclosed within the housing when the partitioning structure is in a retracted position;

wherein two or more of the partitioning structures are extendable from opposite sides of the hub at a same time to partition the surface into at least three portions to provide a feeling of separation from others using the surface, and further wherein the at least two partitioning structures each comprise a securing mechanism that holds the partitioning structure in an extended position and the rigid handles are dimensioned to surround a majority of the perimeter of the hub in the retracted position and independently balance upright in the extended position.

2. The device of claim 1 wherein the hub comprises at least one slit vertically positioned along a side surface of the hub.

3. The device of claim 2 wherein the at least two partitioning structures each comprise a separator, wherein the separator has a ribbon structure.

4. The device of claim 3 wherein the separator is configured to extend from and retract into the hub via the at least one slit.

5. The device of claim 3 wherein images are displayed on at least one of the separator and the hub.

6. The device of claim 1 wherein the at least two partitioning structures each comprise an extension piece coupled to a separator, wherein the separator has an accordion structure.

7. The device of claim 6 wherein the separator is configured to fold out and into the hub.

8. The device of claim 6 wherein images are displayed on at least one of the separator and the hub.

9. The device of claim 1 wherein the at least two partitioning structures each comprise a side platform, a tab, and a separator, wherein the tab is coupled to a top end of the side platform, wherein an interior surface of the side platform is coupled to the separator, and wherein the separator has a fan structure.

10. The device of claim 9 wherein the separator is configured to fold out and into the hub.

11. The device of claim 9 wherein images are displayed on at least one of the separator and the hub.

12. The device of claim 1 wherein the hub is disassembleable.

13. The device of claim 1 wherein the hub is stackable.

14. The device of claim 1 wherein the securing mechanism is an attachment mechanism configured to provide a temporary attachment pairing between the at least two partitioning structures and the surface.

15. The device of claim 1 further comprising at least one container positioned adjacent to the rigid handle at the end of one of the partitioning structures, wherein the container holds items commonly found on the surface.

16. The device of claim 1 further comprising a clip for attaching to documents.

17. The device of claim 1 further comprising an electronic display for displaying at least one of messages, images, and animation.

18. The device of claim 1, wherein the at least two partitioning structures are pulled from an interior of the partition device.

19. The device of claim 1 wherein the rigid handles are dimensioned to cover a majority of a surface on the perimeter of the hub in the retracted position.

20. A surface partitioning tool comprising:

a. a hub having a housing, wherein the hub is placed on a portion of a surface; and b. at least two partitioning structures coupled to a portion of the hub and each having a flexible separator with a rigid handle that extends the length of an end of the flexible separator, wherein two or more of the separators are pulled from opposite sides of the hub at a same time to partition the surface into at least three portions, and further wherein the flexible separator of each of the partitioning structures is enclosed within the housing when the partitioning structure is in a retracted position;

wherein the at least two partitioning structures each comprise a securing mechanism that holds the at least two partitioning structures in an extended position and further wherein the rigid handles are dimensioned to surround a majority of the perimeter of the hub in the retracted position and independently balance upright in the extended position.

21. The surface partitioning tool of claim 20 wherein the separator has a ribbon structure.

22. The surface partitioning tool of claim 20 wherein the separator has an accordion structure.

23. The surface partitioning tool of claim 20 wherein the separator has a fan structure.

24. The surface partitioning tool of claim 20 wherein the at least two partitioning structures are configured to extend from and retract into the hub.

25. The surface partitioning tool of claim 20 wherein the at least two partitioning structures fold out and into the hub.

26. The surface partitioning tool of claim 20 wherein images are displayed on at least one of the separators and the hub.

27. The surface partitioning tool of claim 20 further comprising at least one container positioned adjacent to the rigid handle at the end of one of the partitioning structures, wherein the container holds items commonly found on the surface.

28. The surface partitioning tool of claim 20 further comprising a clip for attaching to documents.

29. The surface partitioning tool of claim 20 further comprising an electronic display for displaying at least one of messages, images, and animation.

30. A method of using a space divider comprising:

a. placing a hub having a housing at a selected portion of a surface, wherein the hub comprises a plurality of partitioning structures coupled to the hub and each having a flexible portion with a rigid handle that extends the length of one end of the flexible portion, wherein at least two of the partitioning structures are configured to extend from opposite sides of the hub to an extended position, and further wherein the flexible portion of each of the partitioning structures is enclosed within the housing when the partitioning structure is in a retracted position and the rigid handles are dimensioned to surround a majority of the perimeter of the hub in the retracted position and independently balance upright in the extended position; and b. partitioning the surface into at least three portions using the plurality of partitioning structures by extending two or more of the partitioning structures to the extended position, wherein each partitioning structure comprises a securing mechanism that holds the partitioning structure in the extended position.

31. The method of claim 30 wherein the partitioning comprises folding out one of the partitioning structures from the hub.

32. The method of claim 30 wherein the partitioning comprises temporarily attaching the partitioning structures to the surface.

33. The method of claim 30 further comprising returning the partitioned space into a non-divided state.

34. The method of claim 33 wherein the returning comprises retracting the partitioning structures into the hub.

35. The method of claim 33 wherein the returning comprises folding the partitioning structures into the hub.

36. The method of claim 30 further comprising displaying at least one of messages, images, and animation on an electronic display.

37. A device to partition a surface comprising:

a. a hub, wherein the hub is positioned on a portion of the surface; and b. a plurality of partitioning structures permanently coupled to a portion of the hub and each having a flexible portion with a rigid handle that extends the length of an end of the flexible portion, wherein each of the partitioning structures are pulled from a different slit on a side of the hub to an extended position, wherein two or more of the slits are positioned on opposite sides of the hub, and further wherein when in an extended position the partitioning structures provide a barrier that divides the surface;

wherein each partitioning structure comprises a securing mechanism that holds the partitioning structure in the extended position and further wherein the rigid handles are dimensioned to surround a majority of the perimeter of the hub in a retracted position and independently balance upright in the extended position.

38. The device of claim 37 wherein the partitioning structures maintain contact with the surface when in the extended position.

39. The device of claim 37 wherein the securing mechanism is able to hold the partitioning structure in the extended position without coupling to an object.

40. A device that divides a table top comprising:

a. a hub positioned on the table top; and b. five or more partitioning structures coupled to the hub each comprising a rigid handle;

wherein the partitioning structures divide the table top in an extended position and the rigid handles are dimensioned to surround a majority of the perimeter of the hub in a retracted position and independently balance upright in the extended position.

41. The device of claim 40, wherein the partitioning structures are all housed within a single chamber within the hub.

42. A device that divides an eating surface comprising:

a. a hub positioned on the eating surface and having a plurality of slits evenly distributed along the side perimeter of the hub; and b. a plurality of separators each having a flexible portion housed within the hub when retracted and a rigid handle that extends the length of an end of the flexible portion and protrudes out of the hub when retracted, wherein the separators are configured to each selectively extend from the hub from a different one of the slits;

wherein the separators divide the eating surface in an extended position and the rigid handles are dimensioned to surround a majority of the perimeter of the hub in the retracted position and independently balance upright in the extended position.

43. The device of claim 42, wherein the eating surface is a table top.

44. The device of claim 42, wherein the eating surface is a counter.

* * * * *